United States Patent [19]

Krake

[11] 4,029,241

[45] June 14, 1977

[54] SPOOL STAND

[76] Inventor: Harry Krake, 3617 Farmington Road, Minnetonka, Minn. 55343

[22] Filed: Aug. 3, 1976

[21] Appl. No.: 711,169

[52] U.S. Cl. ..... 223/106; 211/196

[51] Int. Cl.[2] ..... A41H 31/00

[58] Field of Search ..... 223/106, 107, 108, 109; 211/196; 248/159

[56] References Cited

UNITED STATES PATENTS

| | | | |
|---|---|---|---|
| 76,796 | 4/1868 | Morris | 223/106 |
| 1,746,487 | 2/1930 | Martin | 211/196 X |
| 1,832,730 | 11/1931 | Pack | 248/159 X |
| 2,309,190 | 1/1943 | Heller | 211/196 X |
| 3,151,789 | 10/1964 | Schatz | 223/106 |

FOREIGN PATENTS OR APPLICATIONS

| | | | |
|---|---|---|---|
| 660,354 | 2/1929 | France | 223/106 |
| 431,247 | 8/1967 | Switzerland | 223/106 |

*Primary Examiner*—George H. Krizmanich

[57] ABSTRACT

A spool stand has a base and a top, and a pin cushion disposed on the top. A handle is attached to the pin cushion and a plurality of arms extend transversely to the stand's longitudinal axis, and along the stand's circumference.

4 Claims, 5 Drawing Figures

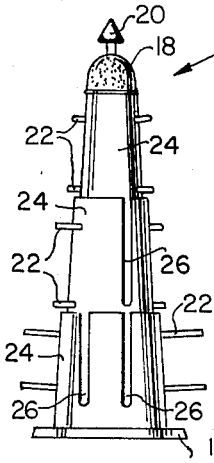
Fig. 2
Fig. 3
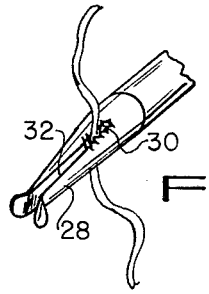
Fig. 5
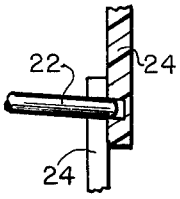
Fig. 4
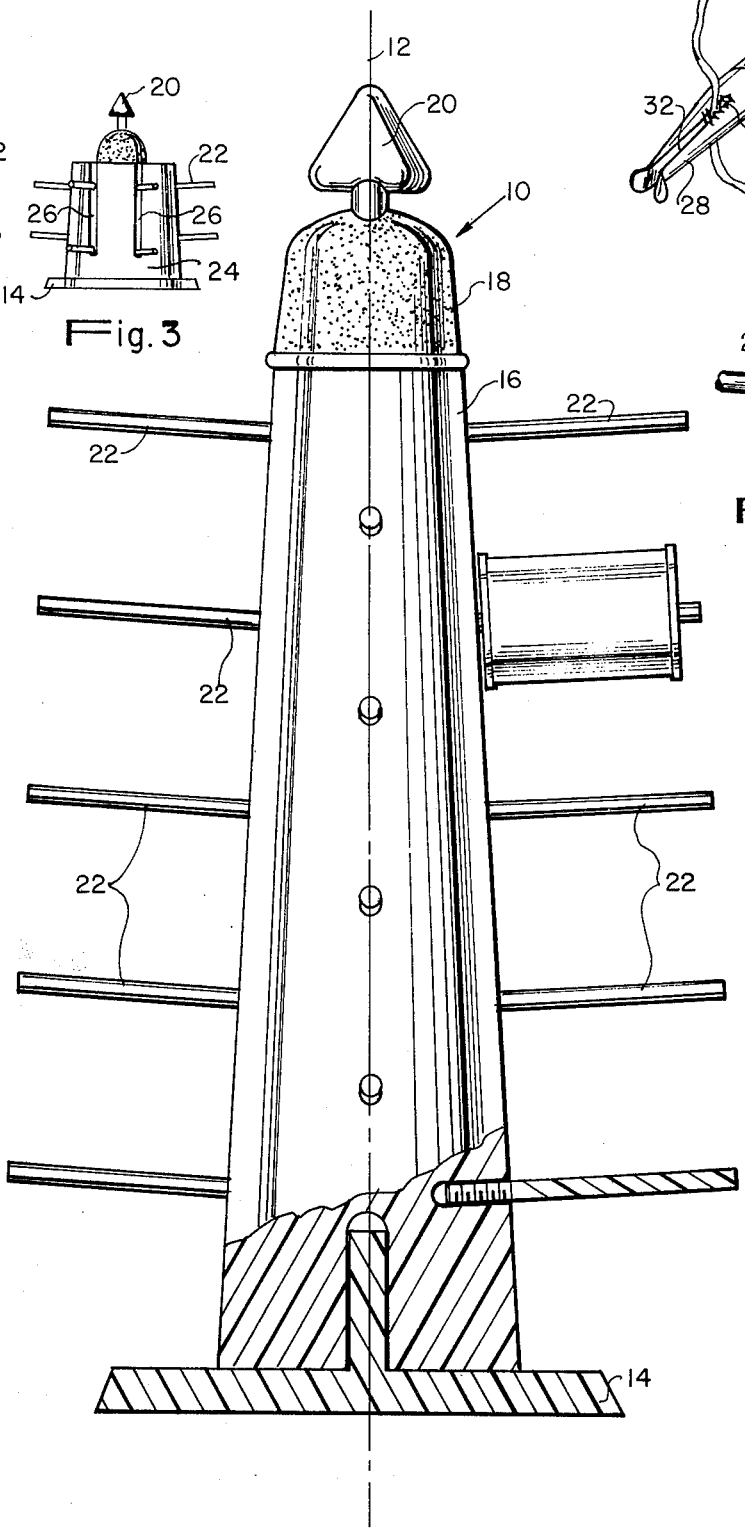
Fig. 1

SPOOL STAND

BACKGROUND OF THE INVENTION

1. Field of the Invention

The field of the present invention relates to a spool stand.

2. Description of the Prior Art

There is known a thread cabinet, a sewing stand, a work stand to hold things connected with domestic sewing, a sewing companion, a combined scissorsrack and spool-holder work stand, a ladies work-table and a spool holder, the latter invention dating back to 1875.

SUMMARY OF THE INVENTION

It is an object of my present invention to provide a miniature spool stand, which is preferably mass producible in plastics, and which may accommodate spools of different colors and of different threads. It is another object of my invention to make the spool stand collapsible.

I accordingly provide a spool stand which has a longitudinal axis, a base and a top, and includes a pin cushion disposed on the top, a handle disposed on the pin cushion, and a plurality of arms extending transversely to the axis along the circumference of the spool stand. The spool stand preferably includes a plurality of concentrically disposed sections, wherein at least two of the arms extend from each of the sections, and wherein one section is a base section and the remaining sections are substantially collapsible into the base section. The sections include a top section, a plurality of intermediate sections and the base section, and each of the intermediate sections and the base section is formed with at least two vertical slots for receiving the arms, respectively. At least one of the arms has preferably an end portion formed with a serrated edge for cutting off a portion of a spool-thread. The end portion is preferably formed with a slit for passing the spool-thread therethrough.

BRIEF DESCRIPTION OF THE DRAWING

My invention will be better understood with reference to the accompanying drawing in which:

FIG. 1 shows one version of the spool stand, according to my invention, in partial elevational cross section;

FIGS. 2 to 5 show an alternate version of the spool stand, according to my invention; in particular:

FIG. 2 shows the collapsible spool stand, fully extended;

FIG. 3 shows the collapsible spool stand in a collapsed position;

FIG. 4 shows a detail of the spool stand of FIG. 2; and

FIG. 5 shows a detail of an arm of the spool stand of FIG. 2.

DESCRIPTION OF THE PREFERRED EMBODIMENT

Referring now to the drawing, a spool stand 10 shown in FIG. 1 has a longitudinal axis 12, a base 14 and a top 16; a pin cushion 18 is disposed on the top 16, and a handle 20 is disposed on the pin cushion 18. A plurality of arms 22 extend transversely to the axis 12 along the circumference of the spool stand 10. The arms 22 are preferably spaced at least 1-¾ inches from one another in order to hold the majority of spools in use today.

In an alternate version of the spool stand, according to my invention, shown particularly in FIGS. 2 to 5, and wherein the same parts are denoted with the same reference numerals, a plurality of concentrically disposed sections 24 are provided, at least two of the arms 22 extending from each of the sections 24, and wherein one of the sections 24 is a base section, and the remaining of the sections 24 are substantially collapsible into the base section 24. The sections 24 also include a top section, at least one intermediate section and the aforementioned base section; the intermediate section 24 and the base section are formed with at least two vertical slots 26 for receiving the arms 22, respectively. At least one of the arms 22 has an end portion formed with a serrated edge 30 for cutting off a portion of a spool-thread. The end portion 28 is preferably formed with a slit for passing the spool-thread therethrough. As can be best seen in FIG. 2, the lowermost arm 22 of the topmost section 24 rests on a rim of the intermediate section 24, and the lowermost arm 22 of the intermediate section 24 rests on the rim of the base section 24, each of the sections 24, as seen from the base section on up being of a frustro-conical shape of respectively decreasing median diameters. The sections 24 can be collapsed from the extended position shown in FIG. 2 to the collapsed position of FIG. 3 by first rotating the topmost section 24 so that the arms 22 thereof are aligned with the slots 26 of the intermediate section 24, and then letting the topmost section 24 slide into the intermediate section 24 by the force of gravity. The intermediate section 24 is similarly collapsible into the base section, there being twice as many slots 26 in the base section to accommodate the arms 26 of the topmost section, the arms of the topmost section 24 protruding from the slits 26 of the intermediate section, when the topmost section is collapsed into the intermediate section.

Although the invention has been described with respect to a preferred version thereof, it is to be understood that it is not to be so limited since changes can be made therein which are within the full intended scope of the appended claims.

What is claimed is:

1. A spool stand having a longitudinal axis, a base and a top, comprising:

a pin cushion disposed on said top;

a handle disposed on said pin cushion;

a plurality of arms extending transversely to said axis along the circumference of the spool stand, and a plurality of concentrically disposed sections, and wherein at least two of said arms extend from each of said sections, one of said sections being a base section, the remaining of said sections being substantially collapsible into said base section.

2. A spool stand according to claim 1 wherein said sections include a top section, a plurality of intermediate sections and said base section, each of said intermediate sections and said base section being formed with at least two vertical slots for receiving said arms, respectively.

3. A spool stand according to claim 1 wherein at least one of said arms has an end portion formed with a serrated edge for cutting off a portion of a spool-thread.

4. A spool stand according to claim 3 wherein said end portion is formed with a slit for passing the spool-thread therethrough.

* * * * *